United States Patent [19]

Faw

[11] Patent Number: 4,567,709

[45] Date of Patent: Feb. 4, 1986

[54] METHOD AND APPARATUS FOR ERECTING A BUILDING

[76] Inventor: Garland Faw, Rte. 11, Box 525-D, Salisbury, N.C. 28144

[21] Appl. No.: 463,346

[22] Filed: Feb. 3, 1983

[51] Int. Cl.[4] ..... E04G 21/14; E04H 1/00

[52] U.S. Cl. ..... 52/745; 52/741; 52/79.5

[58] Field of Search ..... 52/745, 73, 79.5, 741

[56] References Cited

U.S. PATENT DOCUMENTS

| | | | |
|---|---|---|---|
| 284,846 | 9/1883 | Herron | 52/73 |
| 321,722 | 7/1885 | Herron | 52/73 |
| 2,890,498 | 6/1959 | Bigelow . | |
| 3,153,302 | 10/1964 | Wheeler | 52/745 |
| 3,593,482 | 7/1971 | Johnson | 52/745 |
| 3,633,325 | 1/1972 | Bartoli | 52/73 |
| 3,724,157 | 4/1973 | Miram | 52/745 |
| 3,921,354 | 11/1975 | Connelly et al. | 52/73 |
| 4,056,902 | 11/1977 | Ziegler, Jr. | 52/73 |
| 4,171,600 | 10/1979 | Whitney, Jr. | 52/745 |
| 4,400,927 | 8/1983 | Wolde-Tinase | 52/745 |

FOREIGN PATENT DOCUMENTS

| | | | |
|---|---|---|---|
| 158564 | 9/1954 | Australia | 52/79 |

OTHER PUBLICATIONS

"Construction-Mod with Fold-Up 2nd Floor", *Professional Builder,* Aug. 1975.

*Primary Examiner*—Donald G. Kelly
*Assistant Examiner*—Michael Safavi
*Attorney, Agent, or Firm*—Shefte, Pinckney & Sawyer

[57] ABSTRACT

A building having an equal number of exterior wall and roof sections is constructed of prefabricated building units each having a roof section and wall frame section pivotably affixed for relative pivotal movement. The building units are erected in pairs on a foundation assembly by a temporary central column thereat at the upper end of which is temporarily affixed a roof section bracket and is a cable-operated hoisting assembly located above the bracket. Each pair of units is oriented on the foundation on opposite sides of the central column in a folded condition with the roof sections superimposed over the wall section frames and with the inner ends of the roof sections adjacent the column, and the inner ends of the roof sections of the pair of units are then engaged and lifted by the hoisting assembly to an elevated position at the bracket from which the roof sections incline downwardly while the wall section frames are moved outwardly from the central column. The roof sections are then fixed to the bracket, and the wall section frames are fixed to the foundation. Following the erection and affixation in place of each pair of building units, the central column is detached from the bracket and is removed, and the building is finished as desired.

11 Claims, 7 Drawing Figures

METHOD AND APPARATUS FOR ERECTING A BUILDING

BACKGROUND OF THE INVENTION

The present invention relates generally to building construction and particularly to modular-type or prefabricated building wall and roof components and to methods of and apparatus for erecting same.

The rapid rise in the costs of building materials and of construction labor over recent years has been widely publicized and has been accompanied by a corresponding decrease in conventional building construction, particularly home construction. As a result, wide-scale efforts have been made toward the development of less expensive and most cost-efficient construction techniques. The prefabrication of building components in a factory setting permits the realization of the economies attendant to mass production and has become one of the most widely employed techniques in reducing construction costs. While mobile homes represent perhaps the ultimate use of prefabrication techniques, they rarely provide the appearance of a conventional home and continue to be considered significantly less desirable than conventionally-built homes. Homes constructed with modular or prefabricated components have met with somewhat greater acceptance than mobile homes since they provide similar cost savings through factory mass production of the components but still are erected on-site in an otherwise generally conventional manner whereby such homes typically have the appearance and appeal of a conventionally-built home. The major disadvantage of construction using modular or prefabricated components lies in the necessity that the factory-built components nevertheless must ordinarily be erected by a crew of several skilled workmen using special tools. While some savings in erection labor costs are realized in the use of modular or prefabricated components, such savings are relatively minimal and thus the total cost of a home built using such components is ordinarily not significantly less than that of a similar conventionally-built home.

In both mobile home construction and in the construction of modular or prefabricated components, various proposals have been made to alleviate or at least lessen the above-noted problems. Thus, for example, numerous forms of expansible mobile home construction have been designed employing slidable, foldable, pivoting and telescoping wall, roof and other components intended to permit the mobile home to be expanded into building structures of varying shapes and sizes intended to be comparable in appearance to conventional homes. Similarly, it has been proposed to pre-assemble modular and prefabricated units slidably, foldably or the like for easier and quicker erection at the intended building site. Such manners of construction provide some improvement over the aforedescribed construction technique but still ordinarily require skilled labor to accomplish the erection process.

In contrast, the present invention provides a method and apparatus by which the erection of prefabricated, pivotably affixed roof and wall sections may be easily and quickly accomplished at any desired erection site by a small number of unskilled workers employing only the present apparatus and conventional hand tool, thereby facilitating the erection of the walls and roof of a home by its owner enabling the maximization of labor cost savings.

SUMMARY OF THE INVENTION

The method and apparatus of the present invention are particularly adapted for erecting building structures having a plurality of upright walls and roof sections which extend inwardly from the walls, respectively, in sidewise abutment with adjacent roof sections. According to the present invention, a plurality of performed building units are provided, each including one roof section having opposed side edges, an inner end and an outer end and one wall frame section pivotably affixed to the roof section along its outer end for selective pivotal movement with respect thereto.

Briefly described, the present invention provides a method of erecting the building units on an erection surface, i.e. a foundation and flooring system or other supporting surface, by which each building unit is arranged at the erection surface in a folded condition with its roof section superimposed over its wall frame section and the inner end of its roof section adjacent a generally central location of the erection site, causing the inner end of its roof section to be raised to an elevated position with the roof section inclined downwardly therefrom while simultaneously pivoting it wall frame section outwardly with respect to the central location to an upright position, and fixing its roof section and wall frame section in place at their respective inclined and upright dispositions.

The apparatus of the present invention includes a particular arrangement for erecting each building unit from its described folded condition in the above-described manner. Specifically, a columnar assembly is provided for temporary upright disposition at the central location and a hoisting arrangement is provided for disposition at the upward end of the column for engaging the roof section of a folded building unit and raising the roof section to the elevated inclined disposition while permitting outward pivoting of the associated wall frame section to the upright disposition. A bracket adapted to be temporarily affixed to the column at the elevated positions of the inner ends of the roof sections is provided for affixation thereto of such roof section inner ends in their inclined dispositions. The bracket is detachable from the column and the column is removable following the erection of all the building units.

The present invention is preferably employed in the erection of buildings having an even number of walls and roof sections. In such embodiment, the building units are arranged in opposed pairs at opposite sides of the central location and the hoisting arrangement is operated to simultaneously engage and raise the roof sections of each such opposed pair while the outward pivoting of their respective wall frame sections is also simultaneously accomplished. It is preferred that the roof sections be substantially equilaterally shaped with the apexes thereof being their aforesaid inner ends which converge at the aforesaid central location, and each roof section is adapted for engagement adjacent its inner end by the hoisting arrangement. Upon the raising of each pair of units, the upright wall frame sections are affixed to the foundation or other supporting surface at the erection site.

In the preferred embodiment, the columnar arrangement extends upwardly beyond the elevated positions of the roof section inner ends with the hoisting arrangement being disposed to operate from a position above such elevated positions, and the hoisting arrangement is preferably engaged adjacent the inner end of each roof section. The hoisting arrangement preferably includes two pulleys about which are trained respective cables each engagable respectively with one roof section for raising thereof. The cables are associated with a reeling arrangement for simultaneous reeling operation thereof for raising the roof sections and advantageously the reeling arrangement is attachable to the columnar arrangement adjacent the erection surface so that it and the hoisting arrangement may be operated from the erection surface. The columnar arrangement includes a plurality of column sections which may be selectively assemblable and disassemble to permit removal following erection of the building units.

DESCRIPTION OF THE PREFERRED EMBODIMENT

Figure 1:
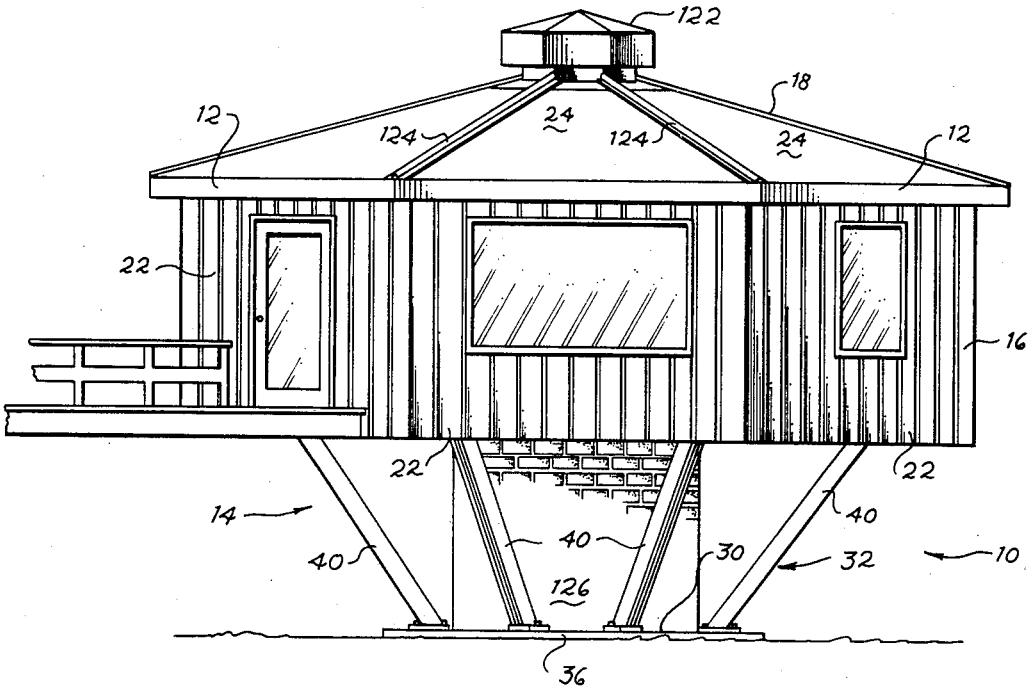
FIG. 1 is a side elevational view of a building structure constructed according to the method and with the apparatus of the present invention.
Figure 7:
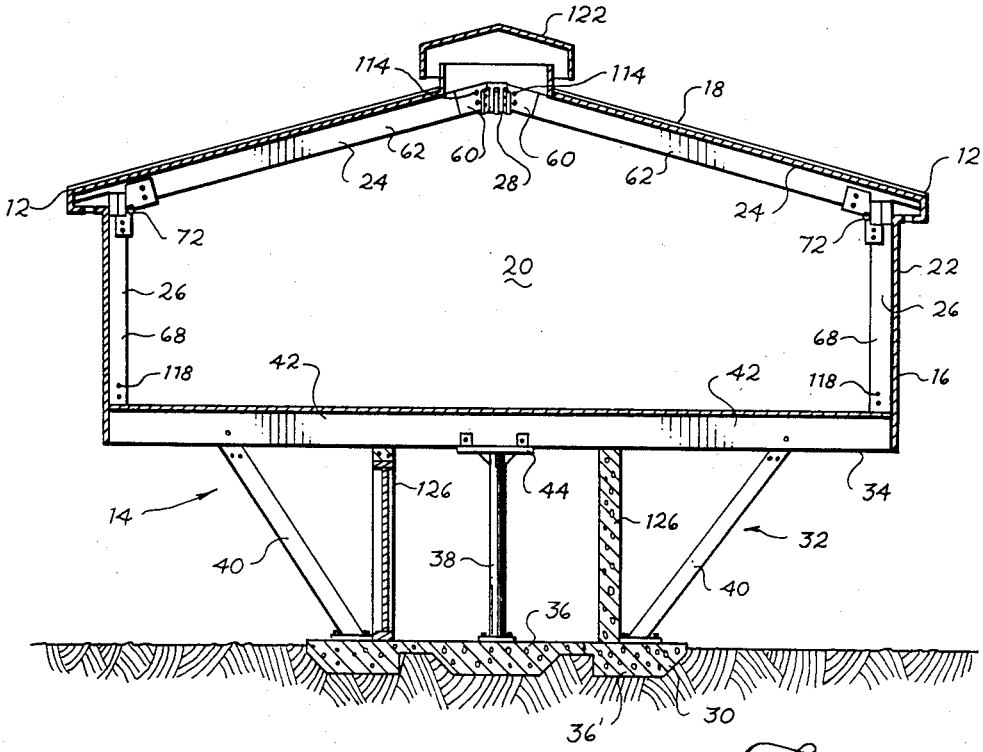
FIG. 7 is a vertical sectional view of the building structure of FIG. 1 taken substantially along line 7—7 thereof.

Referring now to the accompanying drawings and initially to FIGS. 1 and 7, there is shown a building structure indicated generally at 10 embodying a plurality of building units 12 of the present invention erected according to the method and utilizing the apparatus of the present invention. The building structure 10 is particularly adapted and intended for use as a home although it will be understood that the applicability of the present invention is not so limited. Basically, the building structure 10 includes a foundation and flooring system 14, an upright perimeter wall 16, and a roof 18 extending inwardly across the wall 16, thereby providing an enclosed living space 20. In the preferred embodiment, the building structure 10 is substantially octagonal in horizontal cross-section, including eight rectangular wall sections 22 of substantially identical height and width and eight equilaterally triangular roof sections 24 which converge inwardly and are inclined upwardly from the wall sections 22, respectively, in sidewise abutment with adjacent roof sections 24. As more fully explained hereinafter, each building unit 12 of the present invention includes one roof section 24 and a framework 26 for one wall section 22 in pivotal assembly and the building structure 10 preferably does not include any load-bearing interior walls, posts, columns or similar structural members, the central-converging and sidewise-abutting assembled arrangement of roof sections 24 serving to equally distribute the load of the roof 18 and to provide a sufficient degree of self support so that only the eight wall framework sections 26 are needed for supporting the roof 18. For this purpose, a bracket arrangement 28 is provided at the location of convergence of the roof sections 24 to which each of the roof sections 24 is affixed in its desired converging and abutting disposition.

Figure 3:
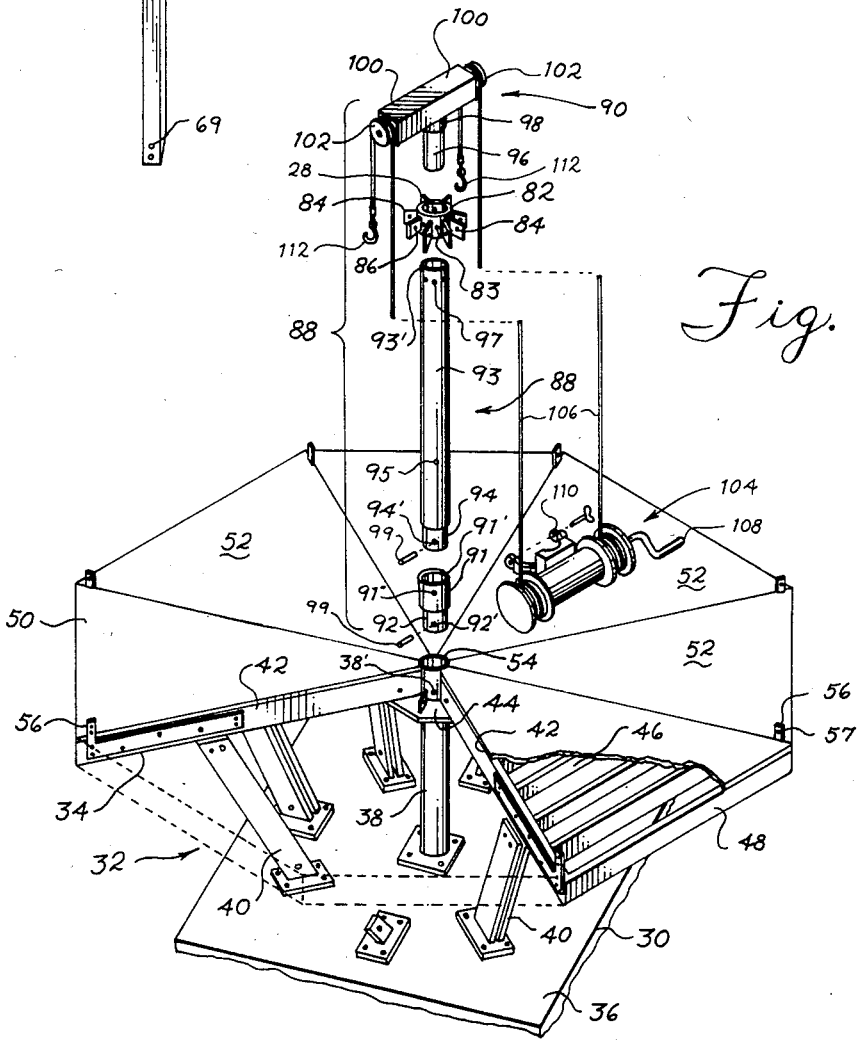
FIG. 3 is a perspective view of the foundation and subflooring structure of the building structure of FIG. 1.

The foundation and flooring system 14 is best seen in FIG. 3 and basically includes a foundation footing 30, an arrangement of supports indicated generally at 32 extending upwardly from the footing 30, and a flooring assembly 34 supported on the support arrangement 32. The footing 30 is a substantially level concrete slab 36 formed in conventional manner on the selected construction site and having a suitable depth below each member of the support arrangement, as indicated at 36'. The support arrangement 32 includes an upright support column 38, preferably a cylindrically tubular steel pipe, centrally affixed to the footing 30 by centrally-located anchor bolts set therein, and includes eight bracing columns 40 affixed to the footing 30 concentrically about the central column 38 by outwardly-spaced anchor bolts and extending angularly upwardly and radially outwardly with respect to the central column 38. The flooring assembly 34 includes eight girder assemblies 42 of substantially identical construction each of which is affixed at one end to a gusset 44 on the central column 38 and extends radially outwardly therefrom to and beyond a respective bracing column 40 to which the girder assembly 42 is affixed and on which it is intermediately supported. A conventional system of floor joists 46 and perimetrically-extending headers 48 extend transversely between and are affixed to the girder assemblies 42, and a plywood sub-floor deck 50 is affixed to the girder assemblies 42, floor joists 46 and headers 48 thereover, the deck 50 conveniently being formed of eight interfitting triagular sections 52 each adapted to cover the flooring assembly 34 between two adjacent girder assemblies 42. For purposes more fully explained hereinafter, the triangular deck sections 52 cooperatively form an opening 54 centrally thereof when fitted together through which the central column 38 extends with its open upper end being substantially flush with the surface of the deck 50. Each girder assembly 42 includes an upstanding flange 56 at its radially outer end which extends upwardly between and projects beyond the deck sections 52 at each corner of the octagonal surface formed thereby and each flange 56 has openings 57 formed therethrough for affixation thereto of a wall framework section 26 as hereinafter further described. While the particular foundation and flooring system 14 is shown and preferred, the present invention is not so limited and any other foundation and flooring system suitably providing an erection surface for erection thereon of the perimeter wall 16 and roof 18 may be employed without departing from the substance and scope of the present invention.

Figure 2:
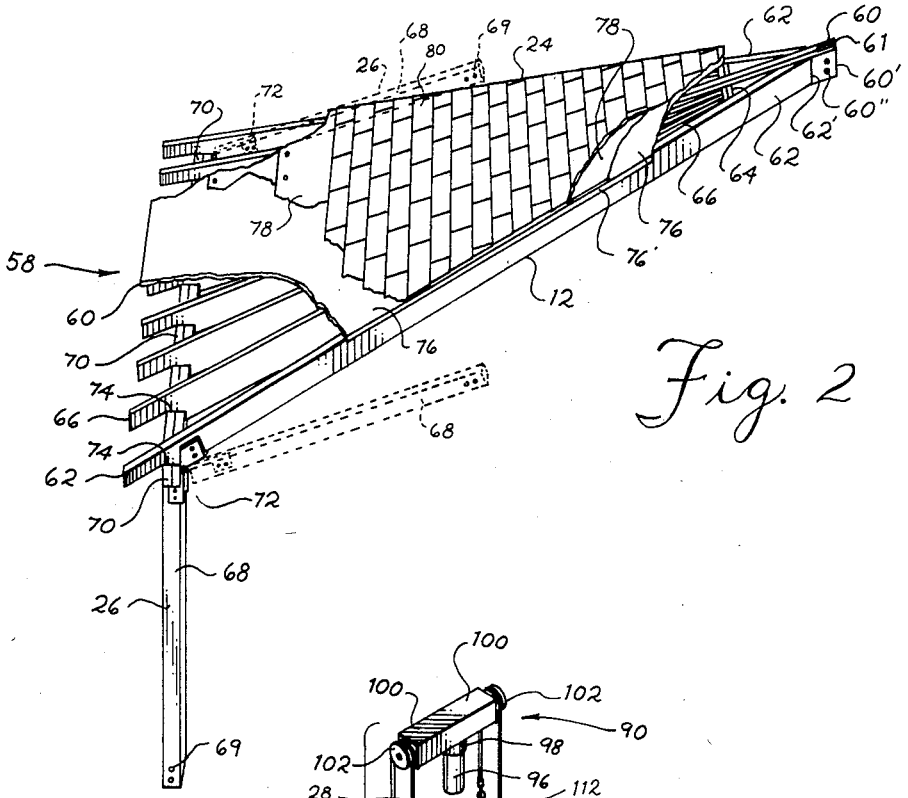
FIG. 2 is a perspective view of one building unit of the present invention embodied in the building structure of FIG. 1.

The construction of the building units 12 may best be understood with reference to FIG. 2 wherein one building unit 12 is shown. Basically, each building unit 12 includes one roof section 24 prefabricated in a substantially completely assembled form and a framework 26 for one wall section 22 pivotally attached to the roof section 24 for selective pivotal movement with respect thereto. The roof section 24 includes an assembly of a plurality of supporting rafters, indicated generally at 58, coplanarly affixed in a generally radially-extending arrangement, plywood roof decking 76 affixed to the rafters 58 thereover, and conventional roofing felt 78 and shingles 80 affixed over the decking 76. The rafters assembly 58 preferably is formed of conventional framing lumber, e.g. 2 inch by 8 inch cross-sectional boards, and includes a primary central rafter 60 constructed of two such boards affixed in side-by-side abutment with a short longitudinal spacing 61 cut between the boards at their inward end 60', and two primary side rafters 62 affixed at respective mitered ends 62' thereof to opposite sides of the central rafter 60 closely adjacent its inward end 60' and respectively radially extending angularly outwardly therefrom. Two braces 64 respectively extend transversely between the central rafter 60 and the side rafters 62 at a further spacing from the inward end 60' and several secondary rafters 66 are affixed at respective ends thereto to and extend radially outwardly from each of the braces 64. The plywood decking 76 is of a substantially equlateral trapezoidal shape covering the radial extent of the rafters 60,62, and 66 from their respective outward ends to the braces 64 and to a transverse extent overhanging the side rafters 62 to a predetermined extent whereby the respective side edges 76' of the decking 76 of the eight roof sections 24 are adapted to cooperatively abut with the side edges of adjacent roof sections 24 in their aforedescribed converging inclined disposition. The two boards of the central rafter 60 are provided with aligned openings 60'' therethrough at the inward end 60' for affixation to the bracket 28 as hereinafter described. Notably, the side rafters 62 so not extend in a perfectly radial manner relative to the central rafter 60 and the bracket 28 due to the affixation of the side rafters 62 to the central rafter 60 at a spacing from its inner end 60' and, thus, in the assembled converging inclined disposition of the roof sections 24, the side rafters 62 of adjacent roof sections 24 do not abut one another but are spaced apart, necessitating the described overhang of the plywood decking 76. This aspect of the construction of the roof sections 24 is significant in the method of erection of the building units 12 hereinafter described.

The wall framework section 26 includes a pair of posts 68 (see FIG. 2) laterally spaced in parallel relation a distance generally the same as the width of one wall section 22 and includes a header 70 extending tranversely across and affixed rigidly to the upper ends of the posts 68. The posts 68 and header 70 preferably are formed of conventional framing lumber, the posts 68 preferably being of conventional 4 inch by 6 inch cross-section and the headers 70 preferably being a length of wood of conventional 4 inch by 10 inch cross-section. The wall framework section 26 is pivotably affixed to the roof section 24 along the outward ends of its rafters by a pair of conventional hinges 72 each of which is respectively affixed to the underside of one side rafter 62 of the roof section 24 and to the inward side of one post 68 of the wall framework section 26. To facilitate the desired range of pivotal movement, the rafters 60,62,66 of the roof section 24 are each provided with a cut-away receiving slot 74 to accommodate the header 70 of the wall framework section 26 in the pivoted condition thereof, whereby the roof section 24 and the wall framework section 26 are adapted to pivot with respect to each other between a folded condition in which they extend substantially adjacently parallel (shown in dotted lines in FIG. 2) and a pivoted erected condition in which they extend in substantially the obtuse angle relation desired between the wall section 22 and roof section 24 in the erected building structure of FIGS. 1 and 7. Each post 68 is provided with openings 69 transversely through the free end thereof spaced correspondingly with the flange openings 57 for bolted or similar affixation to a respective flange 56 as hereinafter described.

Figure 4:
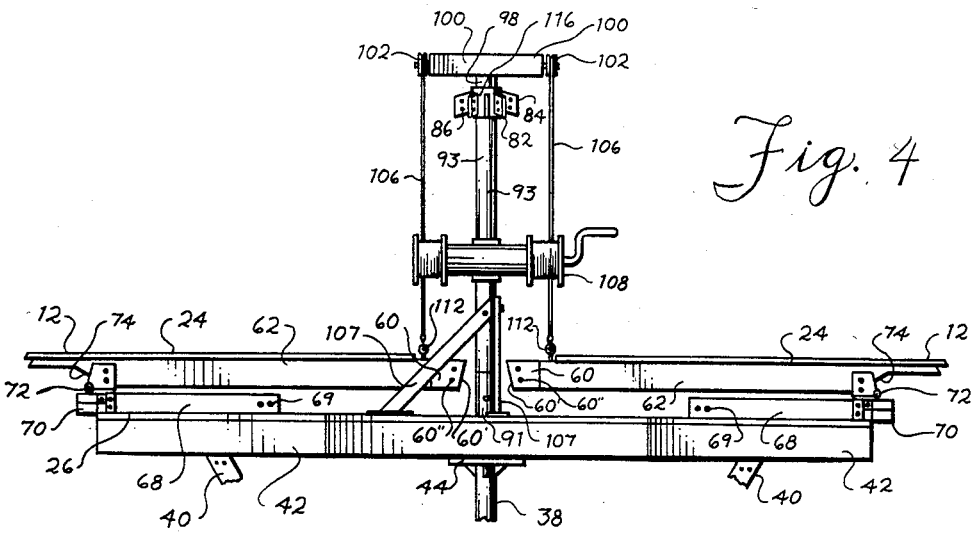
FIGS. 4–6 are side elevational views of the foundation and subflooring structure of FIG. 3 showing sequential stages of the process of erecting two building units thereon.
Figure 5:
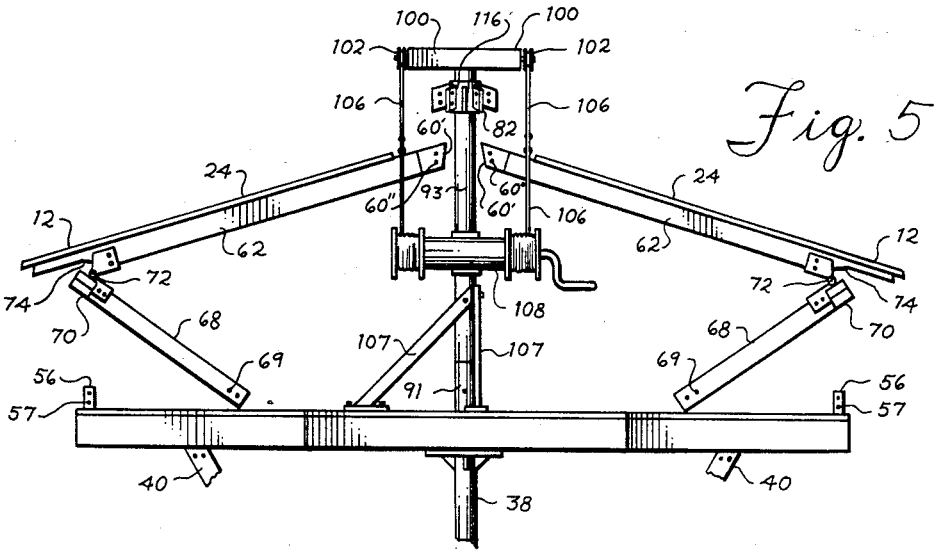
Figure 6:
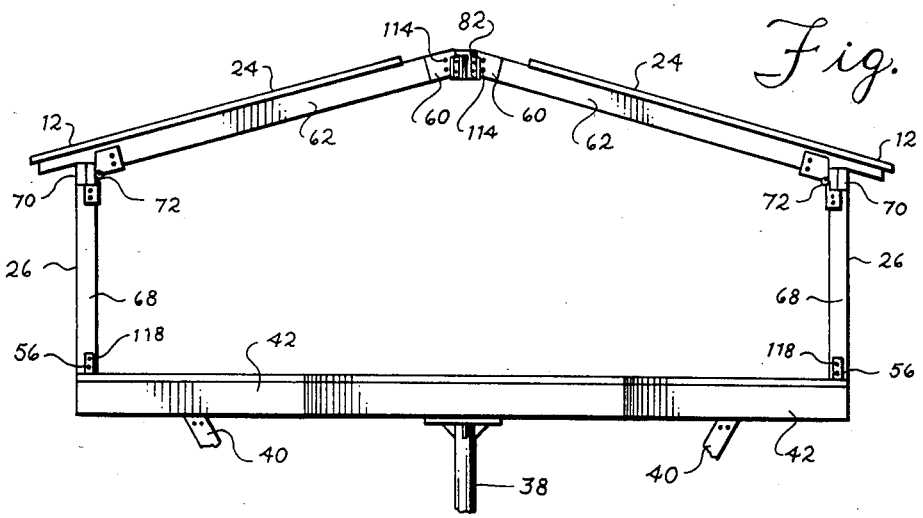

The aforementioned bracket 28 is best seen in FIG. 3 and is formed as a cylindrical steel collar 82 from which eight circumferentially-spaced planar flanges 84 extent radially outwardly in respective axial planes at a downward incline relative to the collar axis of substantially the same angular degree as the upward incline of the erected roof sections 24 of the building structure 10 (see FIGS. 4–6). Each flange 84 is thusly adapted to be inserted into the aforedescribed spacing 61 at the inward end 60' of the central rafter 60 of one respective roof section 24 and each flange 84 is provided with openings 86 therethrough adapted for alignment with the openings 60'' of a rafter 60 of a respective roof section 24 upon such assembly thereof to facilitate bolted or similar affixation thereof as hereinafter described. The collar 82 is also provided with eight threaded openings 83 spaced circumferentially thereabout intermediate the flanges 84 for purposes described later.

A particular mechanical arrangement is provided by the present invention for erecting the building units 12 and fixing their wall section frameworks 26 in desired respective assembly to the foundation and flooring system 15 and their roof sections 24 to the bracket 28, the erection arrangement being shown in exploded form in FIG. 3 and indicated generally at 88. Basically, the erection arrangement 88 provides a columnar extension assembly adapted to be supported vertically upright from the upper end of the central column 38 of the foundation supporting arrangement 32 to extend to an elevation slightly above the desired disposition of the bracket 28 and the inward ends 60' of the roof sections' rafters 60 in the completed building 10 and the columnar assembly is further adapted to carry a hoisting arrangement 90 at the upper end thereof for lifting the building units 12 as hereinafter described. The columnar assembly includes a base column member 91 formed as a relatively short length of cylindrical pipe of substantially the same outer and inner diameters as the central column 38 and having an axial extension 92 from one end of a reduced outer diameter adapted to snugly fit into the open upper end of the central column 38. A primary column member 93 is a substantially greater length of cylindrical pipe also of substantially the same outer and inner diameters as the central column 38 and having an axial extension 94 from one end of a reduced outer diameter adapted to fit snugly into the non-reduced end 91' of the base column member 91. The hoisting arrangement 90 is a pulley assembly including a supporting column 96 of a reduced outer diameter adapted to slidably fit snugly within the non-reduced end 93' of the primary column member 94, which supporting column 96 terminates at its upper end at a radially outwardly-extending shoulder 98 of approximately the same outer diameter as the primary column member 93 for abutment with the end 93' thereof upon assembly in the described manner. Transverse arms 100 extend perpendicularly outwardly from the opposite sides of the shoulder 98 and rotatably carry two pulleys 102 at their respective ends.

The bracket collar 82 has an inner diameter larger than the outer diameter of the column member 93 whereby the collar 82 may be slidably disposed therabout and the column member 93 is provided with eight circumferentially spaced tapped openings 97 therethrough at its non-reduced end 93' adapted for alignment with the openings 83 of the collar 82 to facilitate the affixation of the collar 82 about the column member 93 as further described hereinafter. As will be appeciated and understood, the openings 97 in the column member 93 are formed at a predetermined location longitudinally along its end 93' such that when the collar 82 is affixed thereto and the column members 91,93 are assembled with the column 38 as described, the collar 82 will be disposed centrally above the floor decking 50 at its desired elevation in the finished building 10. As will also be understood, in such assembled upright disposition of the column members 91,93, the collar 82 should be oriented relative to the foundation and flooring system 14 such that its flanges 84 extend in proper radial alignment for affixation thereto of the roof sections 24 in proper relative disposition to the foundation and flooring system 14. For this purpose, respective openings 38',92' are formed in the upper end of the column 38 and in the base column member extension 92 and respective openings 91",94' are formed in the base column member 91 and in the primary column member extension 94 for alignment for such respective openings upon assembly of the base and primary column members 91,93 with each other and with the column 38 to respectively receive a clip pin 99 or the like for affixation of the assembled column members 91,93 and the column 38 to one another against relative rotational movement. The tapped openings 97 are formed in the column member 93 at selected circumferential locations relative to the opening 94' in its extension member 94 such that the collar 82 is properly disposed relative to the foundation and flooring system 14 when it is affixed to the column member 93 and the column members 91,93 and the column 38 are assembled and fixed relative to one another.

A tackle device of conventional construction, indicated only schematically at 104, having two cables 106 and a rotatable crank arrangement 108 for feeding out and winding in the two cables 106 simultaneously is provided for performing the operation of lifting the building units 12, as hereinafter described. The crank arrangement 108 is provided with a gear, block or similar conventional arrangement (not shown) for providing a mechanical advantage in rotation thereof during its lifting operation. The crank arrangement 108 also has a releasable band clamp 110 for engagement about the columnar assembly to facilitate the mounting of the tackle device 104 on the columnar assembly at any circumferential location thereabout. The cables 106 are adapted to be respectively extended upwardly to the pulley assembly 90, trained about its pulleys 102, and extended downwardly therefrom, and each of the cables 106 is provided with an engaging hook 112 at its end. Of course, as will be understood, substantially any other conventional tackle device may also be employed, such as a cable or chain fall mechanism, a come-along mechanism, or the like.

Referring now to FIGS. 4–6, the operation of the present invention will thus be understood. Initially, the bracket collar 82 is slidably positioned about the upper end of the column member 93 and is adjustably positioned thereabout to bring the collar openings 83 and the column member openings 97 into alignment, and thumb screws 116 threaded compatibly with the collar openings 83 and the tapped openings 97 are threadably engaged therethrough to affix the collar 82 temporarily to the column member 93. Next, the columnar assembly 88 of the supporting base member 91 and the primary column member 93 carrying the collar 82 is assembled in upstanding fitted disposition on the central column 38, the column members 91,93 are rotatably positioned to align the respective openings 38',92' and 91", 94' and the clips 99 are inserted through the aligned openings, and the pulley assembly 90 is slidably fitted in the upper end of the primary column member 93, all as above-described. The tackle device 104 is mounted on the primary column 93 by tightening thereabout of the band clamp 110 and the cables 106 are respectively trained about the pulleys 102, as above described. For stability of the columnar assembly, at least two steel angle braces 107 may be affixed to the column member 93 by bolting through holes 95 therein and to the floor decking 50 in respective dispositions extending angularly therebetween at ninety degree spacings about the columnar assembly to rigidify in its upstanding disposition.

As seen in FIG. 4, two building units 12 to be erected at diametrically opposite sides of the building structure 10 are next placed on the floor decking 50 on opposite sides of the centrally-located columnar assembly in their folded condition with their roof sections 24 superimposed over their wall framework sections 26 and are oriented in respective dispositions with their inner ends 60' disposed oppositely adjacent the columnar assembly and their outer ends disposed adjacent opposite sides of the octagonal perimeter of the floor decking 50. As necessary, the pulley assembly 90 is adjusted rotatably within the upper end of the column member 93 to orient the arms 100 and the axis of the pulleys 102 to extend generally parallel with the inward-to-outward extent of the building units 12 and the crank arrangement 108 of the tackle device 104 is correspondingly adjustably positioned on the column member 93 to be vertically intermediate the two arms 100 and building units 12. The hook 112 of each cable 106 is then engaged to the roof section 24 of the respective building unit 12 disposed on the same side of the columnar assembly adjacent the inward end 60' of the roof section 24 preferably by engaging each hook 112 about the exposed portion of the central rafter 60 intermediate the location thereon at which the side rafters 62 and the braces 64 are affixed thereto. The crank arrangement 108 is then operated to reel in the cables 106 to lift the inner ends of the roof sections 24 of the two building units 12 simultaneously. At this point in the lifting process, and as the crank arrangement 108 is continued to be operated to continue the raising of the two roof sections 24, the posts 68 of the two attached wall framework sections 26 are moved outwardly of the columnar assembly toward the floor system perimeter preferably by manual pushing thereof in such outward direction to cause their free ends to slide outwardly along the floor decking 50 (See FIG. 5). Once the two roof sections 24 have been raised to the elevation of the bracket collar 82 and the posts 68 of the two attached wall section frameworks 26 have been moved into upright dispositions at the floor system perimeter, the rotary lifting operation of the crank arrangement 108 is ceased. While maintaining the cables 106 supportingly engaged by their hooks 112 to the two rafters 60, the inward end 60' of each central rafter 60 is adjustably positioned to receive the respective flange 84 of the collar 82 in the slot 61 of the inward end 60' and to align the respective openings 86,60" of the flange 84 and inward rafter end 60' whereupon bolts 114 are inserted through the openings 86',60" and appropriate nuts (not shown) are tightened thereon to fix the roof sections 24 to the collar 82, and the free end of each post 68 is adjustably positioned to align its openings 69 with the openings 57 in the respective flange 56 of the adjacent girder assemblies 42 whereupon bolts 118 are extended therethrough. As will be understood from the further description hereinafter, nuts are not tightened about the bolts 118 at this point in the erection operation, since the adjacent posts 68 of adjacently-erected building units 12 are jointly bolted to each flange 56 according to the present invention.

Following the above-described affixation of the roof section 24 and the wall framework section 26 in erected disposition, the hooks 112 of the two cables 106 are removed from the central rafters 60 of the erected roof sections 24 and the cables 106 are again payed out for repeating the process with another pair of building units. The erection of the six remaining building units 12 is performed in the same manner by erection of opposed pairs of units 12, preferably by next erecting opposed building units immediately adjacent the two first-erected units 12 and proceeding so on until all units 12 are erected and their roof sections 24 and wall framework sections 26 are fixed in place. As previously noted, adjacent posts 68 of adjacently erected building units 12 are to be jointly affixed to opposite sides of the flange 56 at the respectively floor system corner. Accordingly, as further building units 12 are erected following the initial pair of units 12, the adjacently-disposed posts 68 of adjacent erected units 12 are finally fixed in place by alignment of the respective openings 69 of the posts 68 of the subsequently-erected units 12 with the openings 69 of the posts58 of the previously-erected units 12 and with the openings 57 of the respective flange 56 and extension of the bolts 118 fully through the adjacent posts 68 and intermediate flange 56 and tightening of appropriate nuts (not shown) thereon. As previously described, the particular above-described manner of construction of each rafter assembly 58 with the central rafter 60 and the two side rafters 62 causes spacings to be left between the respectively-adjacent side rafters 62 of the roof sections 24 of adjacently-erected units 12 at the centrally-disposed inward ends thereof. As will thus be understood, in the erection of the final pair of building units 12, such spacings which will ultimately remain between the respective side rafters 62 of the roof sections 24 of the final two building units 12 and the adjacent side rafters 62 of the roof sections 24 of the adjacent previously-erected building units 12 at the respective inward ends of each roof sections 24 provide room for the unobstructed upward extension of the cables 106 between the crank arrangement 108 and the pulleys 102 of the pulley assembly 90 which permits the erection of the final two building units 12 in the same manner above-described.

After the erection of all eight building units 12 and their affixation in place, the cables 106 are detached from the pulley assembly 90 and are reeled into the crank arrangement 108, the crank arrangement 108 and the pulley assembly 90 are detached from the column member 93, the angle braces 107 are removed from the column member 93 and from the floor decking 50, the thumb screws 116 are removed from the collar 82 and the column member 93, the retaining clip pins 99 are removed from the column members 91,93 and the column 38, and the column members 91,93 are disassembled and removed. A conventional vent cap 122 is affixed to the roof 18 covering the central opening at the convergence of the roof sections 24 and conventional ridge-type flashing members 124 are affixed to the roof 18 covering the abutting side edges of the roof sections 24, all in conventional manner. As may be necessary and desirable for greater stability of the structure, angle braces (not shown) may be rigidly affixed to the headers 70 of adjacently-erected wall section frameworks 26 to extend across the corner therebetween to hold such wall section frameworks 26 in proper relative upright disposition. The posts 68 and headers 70 of wall framework sections 26 provide structural support for the construction of conventional stud-type frame exterior walls or for the foundation of prefabricated exterior wall units. The finishing of the exterior and interior walls, the finishing of the interior ceiling and flooring, the installation of plumbing, electrical and heating systems are intended to be accomplished in conventional manner and form no part of the present invention. As desired, the foundation area may be enclosed such as by the square concrete block wall 126 to provide an enclosed area for housing the structures' utility controls and the like and for general storage. Notably, the wall 126 is not required for support of the flooring assembly 34, the wall 16 and the roof 18 and therefore may be constructed where and as desired.

The present building unit 12 and the method of and apparatus for erection thereof will be understood to provide distinct advantages over conventional construction operations. As previously indicated and is apparent, the building units 12 readily lend themselves to prefabrication and preassembly by mass production in a factory setting which provides advantages in cost savings and workmanship over conventional on-site construction. Similarly, substantially all remaining materials incorporated in the structure 10 also may be easily prefabricated, whereby all materials necessary to erect a completely enclosed weather-tight structure 10, except for the concrete foundation and wall 126, may be readily produced in the form of an owner-built kit. The manner by which the building units 12 are erected and fixed in place utilizing the columnar assembly of column members 92,94, the pulley assembly 90 and the tackle device 104 requires no special tools other than ordinary household tools such as a hammer and a wrench to fix the nuts and bolts in place and may be readily accomplished by as few as two unskilled workers in only a few hours without undue physical effort. With similar prefabrication of parts and materials, the prior construction of the foundation and flooring system and the subsequent enclosing and weather sealing of the structure may be equally susceptible of construction by generally unskilled workers. Thus, in substantial contrast to previous prefabricated or modular building construction methods and apparatus, the present invention uniquely and truly provides for the simplified and quick erection of a building by a minimal number of unskilled workers. Furthermore, building structures erected according to the present invention advantageously eliminate the need for load-bearing interior columns or walls as are required in many prior art prefabricated or modular structures and therefore the present invention permits complete flexibility in the floor plan design and use of such building structures.

While the present invention has been described and illustrated herein in detail in regard to its preferred embodiment, such detailed disclosure is for purposes of illustration only and it will be recognized that the invention is susceptible of a much broader utility and applicability without departing from its substance and scope. For instance, although an octagonal building structure has been shown and described, the method and apparatus of the present invention may be equally employed for erecting any other polygonal structure and in its broadest sense may be employed for erecting substantially any building having plural perimeter wall sections and roof sections extending inwardly therefrom. The present invention is considered to include within its scope all such modifications and variations and all equivalent arrangements which would be apparent from or reasonably suggested by the foregoing disclosure to those persons skilled in the art and the present invention is therefore not to be limited by the foregoing disclosure but only by the claims appended thereto.

I claim:

1. A method of erecting a building of the type having a plurality of upright walls and roof sections which extend inwardly from said walls, respectively, in sidewise abutment with adjacent roof sections, said method comprising the seps of:

(a) providing a plurality of performed building units each comprising one said roof section having opposed side edges, an inner end and an outer end, and comprising a wall frame section pivotally attached to said roof section along said outer end thereof for selective pivotal movement with respect thereto; and (b) sequentially erecting a plurality of groups of less than all said building units, including for each said group of building units:

(i) arranging said group of building units on an erection surface in opposition to one another with each building unit in a folded condition with its said roof section superimposed over its said wall frame section, and with said inner end of its said roof section being arranged adjacent a generally central location of said erection surface;

(ii) causing said inner end of said roof section of each building unit to be raised to an elevated position with its said roof section being inclined downwardly therefrom while simultaneously pivoting its wall frame section outwardly with respect to said central location of an upright position; and (iii) fixing said roof section and said wall frame section of each building unit in place at said respective inclined and upright dispositions thereof.

2. A method of erecting a building according to claim 1 and characterized further in that said raising of said roof sections includes hoisting said roof section of each said building unit from a position elevated above said central location.

3. A method of erecting a building according to claim 2 and characterized further by the steps of providing columnar means at said central location extending upwardly thereat, performing said hoisting of each said roof section from the upward end of said columnar means, and removing said columnar means from said central location following said hoisting and said fixing of all said roof sections.

4. A method of erecting a building according to claim 3 and characterized further by the steps of temporarily affixing bracket means to said columnar means at said elevated positions of said inward ends of said roof sections, said fixing of said roof sections including affixing the inward end of each roof section to said bracket means, and detaching said columnar means from said bracket means following said fixing of all said roof sections.

5. A method of erecting a building according to claim 4 and characterized further in that said building has an even number of said walls and said roof sections, and in that said arranging of said building units includes positioning said building units in opposed pairs at opposite sides of said central location, and characterized further by performing said hoisting and pivoting simultaneously on each opposed pair of said building units.

6. A method of erecting a building according to claim 5 and characterized further by the step of providing said erection surface with a supporting foundation, with said fixing of said wall frame sections including affixing each said upright wall frame section to said supporting foundation.

7. A method of erecting a building according to claim 5 and characterized further in that said hoisting of said roof sections includes lifting said inner end of each said roof section.

8. A method of erecting a building according to claim 1 and characterized further in that said building has an even number of said walls and said roof sections and in that said arranging of said building units includes positioning said building units in opposed pairs at opposite sides of said central location, and characterized further by performing said raising and pivoting of said roof sections and wall frame sections simultaneously on each opposed pair of said building units.

9. A method of erecting a building according to claim 8 and characterized further in that said raising of said roof sections includes hoisting said inner end of said roof section of each said building unit from a position elevated above said central location.

10. A method of erecting a building according to claim 9 and characterized further by the step of forming each said roof section with a substantially equalaterally triangular shape with the apex thereof being said inner end, providing columnar means at said central location extending upwardly thereat to an elevation above said elevated positions of said inward ends of said roof sections, temporarily affixing bracket means to said columnar means at said elevated position of said inner ends of said roof sections, performing said hoisting of each said roof section from the upward end of said columnar means, said fixing of said roof sections including affixing the inner end of each roof section to said bracket means, and detaching said columnar means from said bracket means and removing said columnar means following said hoisting and fixing of all said roof sections.

11. A method of erecting a building of the type having a regular polyhedral plane space defined by a plurality of identical upright walls angularly arranged in equilateral plan relation and a plurality of equilaterally triangular roof sections which extend inwardly from said walls, respectively, in sidewise abutment with adjacent roof sections, said method comprising the steps of:

(a) providing a plurality of preformed building units each comprising one said roof section having opposed side edges, an inner end and an outer end, and comprising a wall frame section pivotally attached to said roof section along said outer end thereof for selective pivotal movement with respect thereto;

(b) providing an erection surface for supporting said building and an upright column removably disposed at a central location on said erection surface;

(c) sequentially erecting pairs of said building units, including for each said pair of building units:

(i) arranging said pair of building units on said erection surface in opposition to one another at opposite sides of said column with each building unit in a folded condition with its said roof section superimposed over its said wall frame section, and with said inner end of its said roof section being arranged adjacent said central location of said erection surface;

(ii) simultaneously hoisting said inner ends of said roof sections of said pair of building units from the upper end of said column to an elevated position with said roof sections of said building units being inclined downwardly from said elevated position, while simultaneously pivoting said wall frame sections of said building units outwardly with respect to said central location to respective upright dispositions; and (iii) operatively connecting with one another said inner ends of said roof sections of said pair of building units to fix said roof sections in place in their said inclined dispositions and fixing said wall frame sections of each building unit in place in their respective upright dispositions;

(d) fixing the adjacent side edges of said roof sections in sidewise abutment with one another; and (e) removing said column from said central location following said erecting.

* * * * *